US008624697B2

(12) United States Patent
Shang

(10) Patent No.: US 8,624,697 B2
(45) Date of Patent: Jan. 7, 2014

(54) ASSEMBLING MAGNETIC COMPONENT

(75) Inventor: Sywe-Rung Shang, Keelung (TW)

(73) Assignee: Curie Industrial Co., Ltd., Ta Wu Keelung (TW)

( * ) Notice: Subject to any disclaimer, the term of this patent is extended or adjusted under 35 U.S.C. 154(b) by 178 days.

(21) Appl. No.: 13/164,367

(22) Filed: Jun. 20, 2011

(65) Prior Publication Data

US 2012/0319812 A1 Dec. 20, 2012

(51) Int. Cl.

| | |
|---|---|
| ***H01F 27/02*** | (2006.01) |
| ***H01F 17/06*** | (2006.01) |
| ***H01F 27/30*** | (2006.01) |
| ***H01F 27/24*** | (2006.01) |
| ***H01F 17/04*** | (2006.01) |

(52) U.S. Cl.

USPC ..... 336/83; 336/96; 336/178; 336/198; 336/212; 336/219; 336/221; 336/233

(58) Field of Classification Search

USPC ..... 336/96, 178, 198, 212, 219, 221, 233, 336/83

See application file for complete search history.

(56) References Cited

U.S. PATENT DOCUMENTS

| | | | | |
|---|---|---|---|---|
| 4,943,793 | A * | 7/1990 | Ngo et al. | 336/83 |
| 2006/0012457 | A1* | 1/2006 | Reppe et al. | 336/212 |
| 2006/0186979 | A1* | 8/2006 | Kawarai | 336/83 |
| 2011/0241815 | A1* | 10/2011 | Lu | 336/198 |

* cited by examiner

*Primary Examiner* — Tsz Chan

(74) *Attorney, Agent, or Firm* — Jackson IPG PLLC

(57) ABSTRACT

The main purpose of this invention is to improve high forming pressure of existing Fe—Si—Al insulating magnetic powder which is not suitable for forming, combine heterogeneous insulating magnetic powder, produce hollow cup-like cover and Fe—Si—Al rod core for full magnetic path component assembling, and change the shape structure of rod core and cover design, so there will be advantages including easy to winding, assemble and cooling.

2 Claims, 5 Drawing Sheets

ASSEMBLING MAGNETIC COMPONENT

BACKGROUND OF THE INVENTION

1. Technical Field

This invention mainly assembles the rod core and cover assembling structure produced by heterogeneous insulating magnetic powder, in order to meet the advantage characteristics, including easy coiling, assembling and heating dissipation.

2. Description of Related Art

The large current assembling magnetic component used in market condition is mainly separated into the following two types:

Type 1: As for rod core and cover integral magnetic component, top and bottom covers of iron insulating magnetic powder are used to assemble the finished product. As demonstrated in FIG. 26, the rod core is built in top and bottom covers, so there is no separated rod core.

Type 2: Concerning the magnetic component of separated rod core and cover, cover of iron or Fe—Si insulating magnetic powder is used to be assembled with rod core of iron or Fe—Si insulating magnetic powder, which is demonstrated in FIG. 27.

However, there are several obvious disadvantages in the above two traditional magnetic components, which is demonstrated in the comparative table in Brief summary of the invention.

BRIEF SUMMARY OF THE INVENTION

Before describing the technology content of this invention, please allow us to define or explain the material or technology applied in this invention as follow:

Rod core: The magnetic inductive material surrounded by coil in general magnetic component, which can be single individual or with components according to requirements, and there are different shape variations, such as T type and rod type.

Magnetic powder: Iron powder or alloy powder with magnetic characteristic. Resin obtained from market condition is used to perform surface insulation coating, to form magnetic powder with insulation characteristic on the surface. After that, it will form through pressing by cold-forming technology.

Coil: Coil mentioned in this invention is copper wire with insulation surface which coils and becomes coils in single or multiple turns, in order to carry current and generate external magnetic field.

Assembly: Assembly mentioned in this invention is to reserve holes, tenon, and location design for assembly of each component previously, and combine by mechanical or manual means. Common glue sold in market condition can be used for adhesion between each component, such as epoxy resin, silica gel, and instant glue.

Cold forming technology: Press the powder to form. Mechanical pressure is mainly used to form, and then the product is completed by annealing and sintering.

The following is the advantage and disadvantage comparison of existing Type 1, Type 2 products and this invention, for understanding of characteristics and differences:

| Comparison | The aim of this invention | Traditional type 1 | Traditional type 2 |
|---|---|---|---|
| Difference explanation | Top cover, bottom cover and rod core are separated, which will be assembled with coil to form finished product afterwards. | Top cover and bottom cover are formed, which will be assembled with coil to form finished product afterwards, rod core is built in top and bottom covers, so there is no rod core. | Single cover and rod core are formed, which will be assembled with coil to form finished product afterwards. |
| Multiple material combination | Yes. | No; rod core is built in top and bottom covers, so rod core requires top and bottom cover materials. | Yes. |
| Using high-length Fe—Al—Si rod core | Yes; high-length Fe—Al—Si rod core can be produced by using the prescription of this invention. | No; it can't be formed because of high forming pressure. | Yes; but only for short-length Fe—Al—Si rod core. |
| Forming pressure for unit area | Lowest; each component is formed separately, so the forming pressure is the lowest. | High. | Medium. |
| Using coil with large diameter wire (>1.7 mm) | Yes. | Yes. | No; because of cover space limitation, large diameter wire can't be used. |
| Application of high current and high inductor | Yes. | No recommended; because when using iron powder as the material, the core loss is too high, which is not suitable for the application of high current and high inductor. | No recommended; because coil with large diameter wire can't be used, it is not suitable for the application of high current and high inductor. |
| Variability of cover or rod core structure | Yes; because of the lowest forming pressure, there is structure variability in mold/finished product. | No. | Yes; because of forming pressure limitation, the variability is less. |

From the comparison of the above table, it is demonstrated that this invention achieves the characteristics of Fe—Al—Si long rod core production, and component respective forming. Comparing to the former Type 1 and Type 2, there are advantages including multiple structure variation, and using in application of high current and high induction.

DETAILED DESCRIPTION OF THE INVENTION

Figure 1:
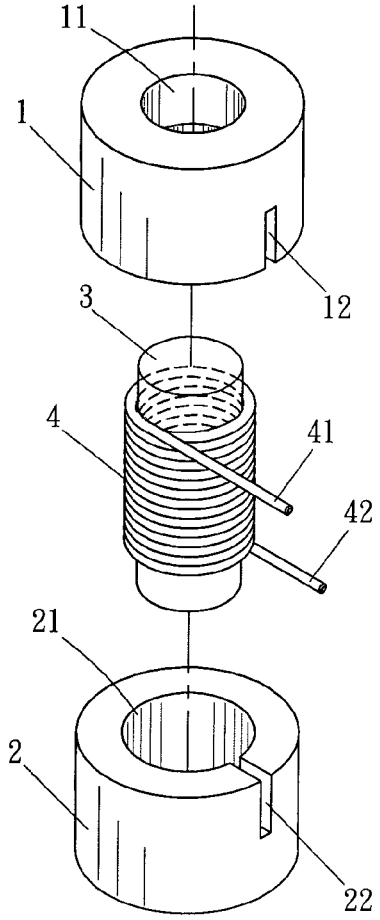
FIG. 1 is the exploded three-dimensional figure of assembling magnetic component in this invention.
Figure 2:
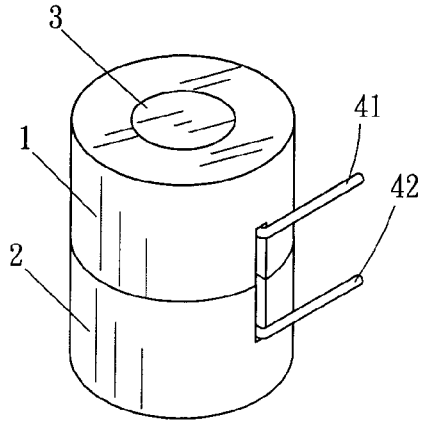
FIG. 2 is the three-dimensional figure of assembling magnetic component product in this invention.

As demonstrated in FIGS. 1 and 2 of this invention, assembling magnetic component in this invention is mainly composed of top cover (1), bottom cover (2), rod core (3), and coil (4).

The basic shape of above-mentioned top cover (1) and bottom cover (2) is cup-like body. There is one through hole in the center (11), (21) and one rectangle hole on the side (12), (22).

The material of top cover (1) and bottom cover (2) is iron or Fe—Si insulating magnetic powder. It forms after cold-forming technology. The width range of rectangle hole (12), (22) is 0.5 mm~10 mm, and the diameter of top cover (1) and bottom cover (2) is recommended to be 20 mm~120 mm. The wall thickness of top cover (1) and bottom cover (2) is recommended to be more than 1 mm. As for the above-mentioned size, the actual size will be in accordance with customer's electric property requirement. The main function of top cover (1) and bottom cover (2) is to be the medium of magnetic field path and provide the whole component environment protection.

The basic shape of above-mentioned rod core (3) is solid cylinder, and the material is the insulating iron powder made by Fe—Al—Si powder. It forms after cold-forming technology. In this invention, 0.1%~10% copper powder is added into insulating magnetic powder. Copper powder is softer, so it effectively reduces friction of green part release and strengthens green tape strength. The cylinder's outer diameter is less than the inner diameter of through hole (11), (21) in the top cover (1), and bottom cover (2). The main function of rod core (3) is to provide inductive magnetic field, and the height (length) of rod core (3) product could be more than 52 mm.

The above-mentioned coil (4) mainly coils on rod core (3). Electrical connectors (41), (42) extend at two ends. After the assembling of top cover (1) and bottom cover (2), electrical connectors (41), (42) extend outward through rectangle hole (12), (22) in the cover's wall. The main function of coil is for the current flow from one of the electrical connectors (41) or (42), which produces external magnetic field.

The assembling is to set rod core (3) into coil (4), and then put two ends into the through hole (11), (21) of top cover (1) and bottom cover (2) separately. After top cover (1) and bottom cover (2) combine and electrical connectors (41), (42) extending from two ends of the coil (4) extend outward through rectangle hole (12), (22), glue is used to bind to top cover (1) and bottom cover (2) and assemble the assembling magnetic component of this invention.

Figure 3:
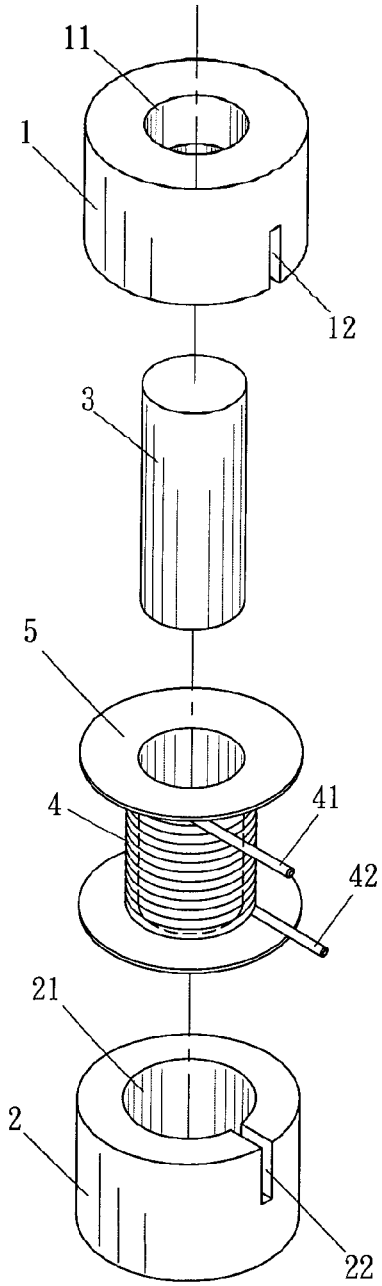
FIG. 3 is the exploded three-dimensional figure of coil winding on insulating bobbin in this invention.

When rod core (3) is too long or coiling winding is considered, method demonstrated in FIG. 3 can be used when putting into practice. Coil is winded at insulating bobbin (5), which is assembled with rod core (3), top cover (1) and bottom cover (2) afterward.

Component and the Derivative Variation of Design

Figure 4:
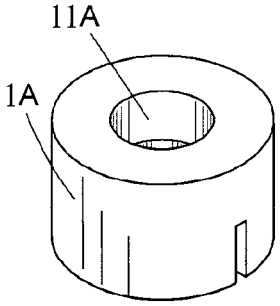
FIGS. 4 to 6 are the three-dimensional figures of top and bottom covers with different variations in this invention.
Figure 5:
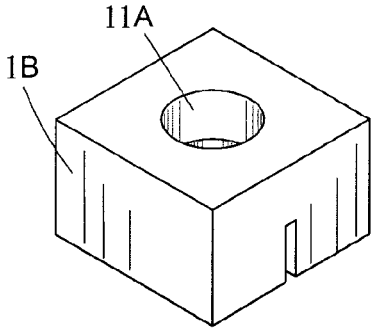
Figure 6:
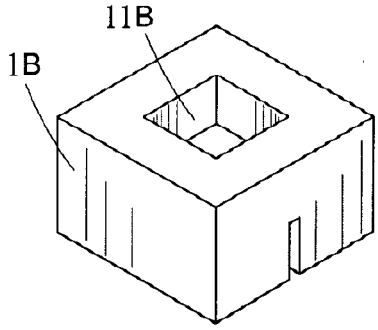

A. Variation of Top and Bottom Covers:

Please see FIGS. 4 to 6 as the reference. Top cover (1), bottom cover (2), through hole (11), (21) and rectangle hole (12), (22) of this invention include the following shape variations:

As demonstrated in FIG. 4, top cover and bottom cover are cylinder covers (1A), in which rod core through hole is circle (11A), and the assembled rod core is also cylinder;

As demonstrated in FIG. 5, top cover and bottom cover are square covers (1B), in which rod core through hole is circle (11A), and the assembled rod core is also cylinder;

As demonstrated in FIG. 6, top cover and bottom cover are square covers (1B), in which rod core through hole is square (11B), and the assembled rod core is also square column.

Figure 7:
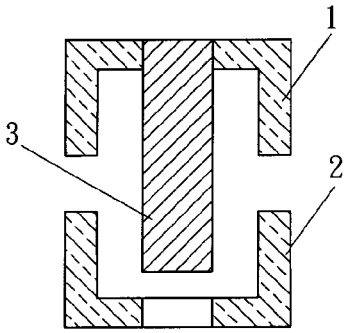
FIGS. 7 to 9 are the cross section views of top and bottom covers with different height variations in this invention.
Figure 8:
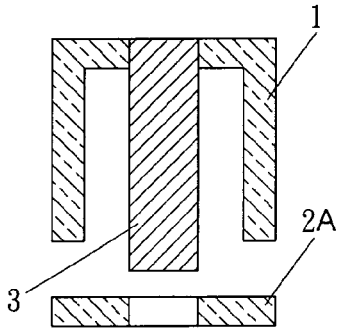
Figure 9:
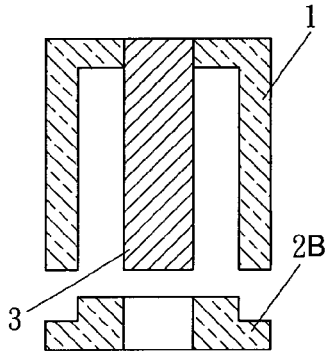

Please see FIGS. 7 to 9 as the reference. The following are the main variations in the height of top cover (1) and bottom cover (2) in this invention:

As demonstrate in FIG. 7, top cover (1) and bottom cover (2) are cup-like bodies in the same height.

As demonstrated in FIG. 8, top cover (1) is still cup-like body, but bottom cover (2) is flat plate body (2A);

As demonstrated in FIG. 9, top cover (1) is still cup-like body, but bottom cover (2) is trapezoidal body (2B) with thick middle and thin outer edge.

Figure 10:
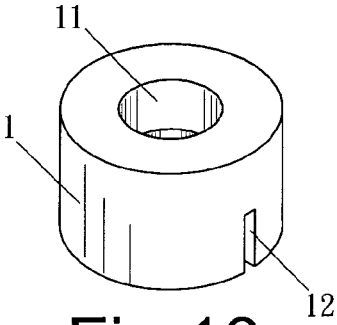
FIGS. 10 to 14 are the three-dimensional figures of top and bottom covers with different through hole variations in this invention.

Please see FIGS. 10 to 14 as the reference. The following are the main variations of through hole (11), (21) and rectangle hole (12), (22) in top cover (1) and bottom cover (2) of this invention:

As demonstrated in FIG. 10, there are two holes in the cover. One is in the center in the cup-like cover. It's used for rod core assembling. Another is the rectangle hole in the cover's wall. It's retained as the exit of coil (4) electrical connector (41).

Figure 11:
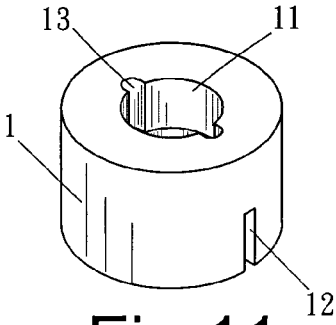
Figure 12:
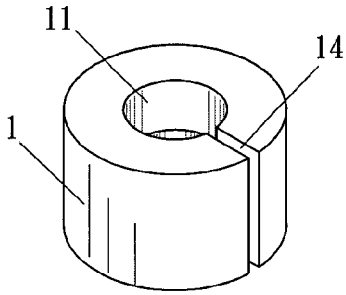
Figure 13:
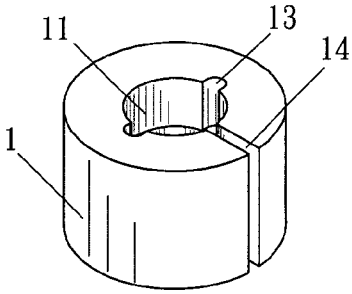

As demonstrated in FIG. 11, in addition to the through hole (11), (21) of rod core (3) at top cover (1) and bottom cover (2), there are single or several function holes (13) on the inner edge. The function of function hole (13) will be illustrated in the follow-up application chapter;

As demonstrated in FIG. 12, in addition to the through hole (11), (21) of rod core (3) at top cover (1) and bottom cover (2), there is a connected L-shape opening (14) at the end and the side. This approach will be helpful to use larger copper wire and expose surface area for effective cooling;

As demonstrated in FIG. 13, in addition to the through hole (11), (21) of rod core (3) at top cover (1) and bottom cover (2), there are function hole (13) and L-shape opening (14) simultaneously. However, too many holes will cause the emission of magnetic line and the reduction of AL, inductance rating.

Figure 14:
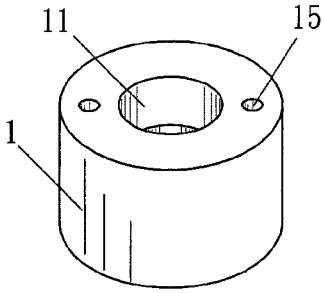

As demonstrated in FIG. 14, in addition to the through hole (11), (21) of rod core (3) at top cover (1) and bottom cover (2), coil through hole (15) of electrical connector (41), (42) is set next to through hole (11), (21).

As for the function hole (13) and L-shape opening (14) of top cover (1) and bottom cover (2), the total hole length is asked to be less than ⅓ diameter of through hole (11), (21) by this patent design. Therefore, induction decline can be controlled within 10%.

B. Rod Core Variation

Figure 15:
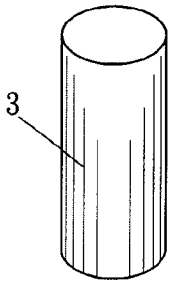
FIGS. 15 to 17 are the three-dimensional figures of rod core with different variations in this invention.
Figure 16:
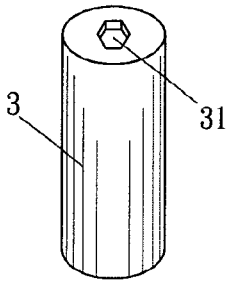
Figure 17:
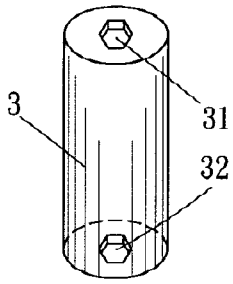
Figure 18:
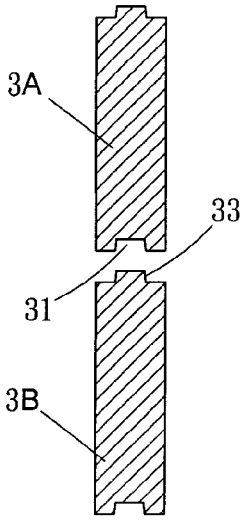
FIGS. 18 to 20 are the cross section views of rod core with different variations in this invention.
Figure 19:
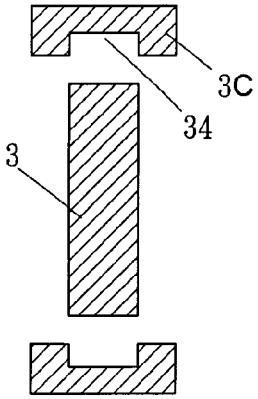
Figure 20:
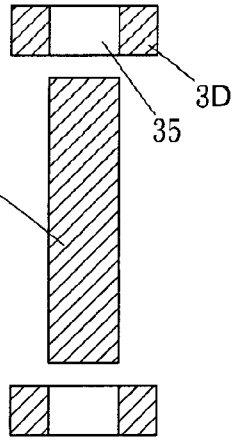

Please see FIGS. 15 to 20 as the reference. Rod core (3) of this invention includes the following structure variations:

As demonstrated in FIG. 15, the rod core (3) is solid cylinder rod core;

As demonstrated in FIG. 16, a counterbore (31) is set at one end of rod core (3). The shape of counterbore includes circle, triangle, rectangle and hexagon, which are easy to make. This counterbore can be used for the axis driving force of coil winding;

As demonstrated in FIG. 17, counterbores (31), (32) are set at two ends of rod core (3). The shape of counterbore includes circle, triangle, rectangle and hexagon, which are easy to make. This counterbore can be used for the axis driving force of coil winding;

As demonstrated in FIG. 18, a counterbore (31) or a lug (33) is set at one end of rod core (3), or counterbore (31) and lug (33) are set at two ends of rod core (3) respectively. This approach is able to produce long rod core or use different magnetic material effectively;

As demonstrated in FIG. 19, the rod core (3) is three-piece assembling. The middle is solid rod shape rod core (3), and the upper and bottom sides are groove rod cores (3C) with groove (34). After assembling, I shape is formed, which is beneficial for coil winding;

As demonstrated in FIG. 20, the rod core (3) is another kind of three-piece assembling. The middle is solid rod shape rod core (3), and the upper and bottom sides are ring-like rod cores (3D) with hole (35). After assembling, I shape is formed, which is beneficial for coil winding.

Figure 21:
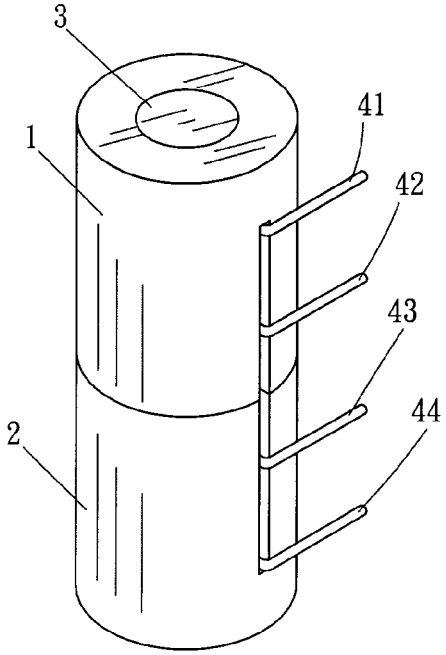
FIG. 21 is the three-dimensional figure of top and bottom covers with multiple coil combination in this invention.

As demonstrated in FIG. 21, one or more rod cores (3), (3B) are connected and put into more than two coils (4A), (4B), and then top cover (1) and bottom cover (2) are combined, which produces magnetic component of multiple electrical connectors (41), (42), (43) &(44).

Figure 22:
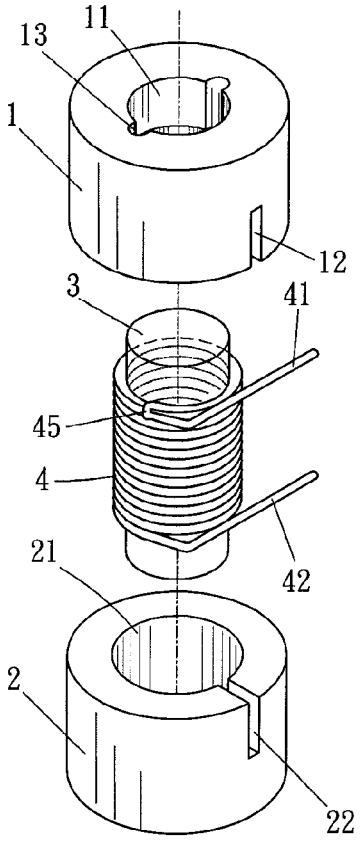
FIGS. 22 to 25 are the three-dimensional figures of function demonstration of function hole in this invention.

Application Explanation of Function Hole:

The following are the functions of the above-mentioned function hole (13):

A. Line escaping function: As demonstrated in FIG. 22, coil (4) is produced by insulating cooper wire winding. After that, the electrical connector (41), (42) of extended magnetic component must bend from the inner part of coil (4), in order to connect to circuit board electricity. This bend part will cause a bending convex circle section (45), and function hole (13) will provide the space for this bending convex circle section.

Figure 23:
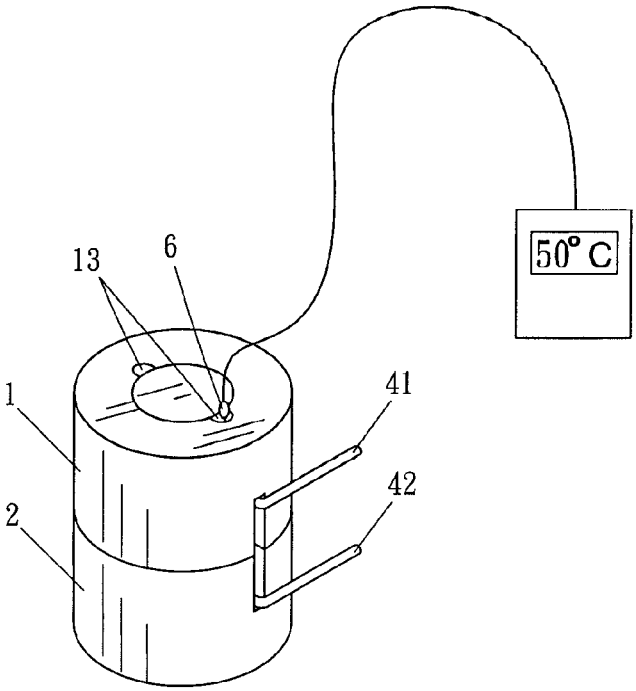

B. Temperature detection wire binding function: As demonstrated in FIG. 23, there is usually higher heat problem in the coil inner part of general magnetic component. This function hole (13) can be used to set temperature detector (6), which detects the heat condition of magnetic component.

Figure 24:
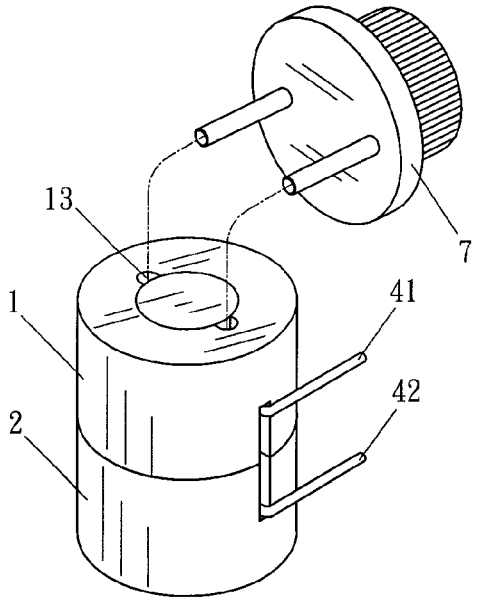

C. Heat sink binding function: As demonstrated in FIG. 24, this function hole (13) can be used to bind heat sink (7), and it can bring out the heat generated in the coils.

Figure 25:
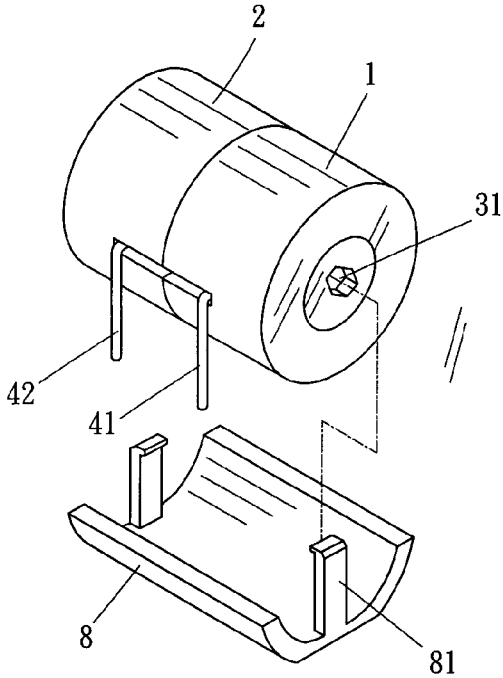
Figure 26:
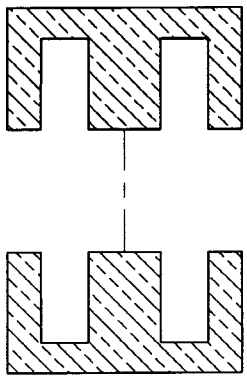
Prior Art Fig.26
FIG. 26 is the exploded three-dimensional figure of traditional magnetic component with integral rod core and cover.
Figure 27:
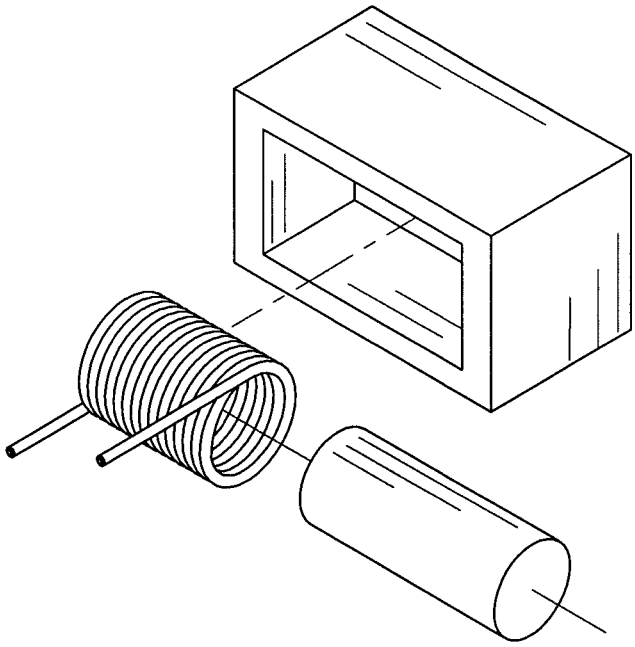
Prior Art Fig.27
FIG. 27 is the exploded three-dimensional figure of traditional magnetic component with separated rod core and cover.

D. Base binding tenon function: As demonstrated in FIG. 25, in specific condition, insulating base is asked (8) to be set between circuit boards, and then magnetic component can be fixed on circuit board. Function hole (13) can be used as the fixing hole of tenon (81) binding.

The invention claimed is:

1. A magnetic component assembly, which includes:

a top cover;

a bottom cover, wherein each of the top and bottom covers are respectively symmetrical and have a cylindrical cup-like shape and a centrally arranged through hole and a rectangular hole arranged at a side at the side, and wherein the top and bottom covers are cold-formed of insulating magnetic powder of iron or Fe—Si with a width range of the rectangle hole of 0.5 mm to 10 mm, and a diameter of the top and bottom covers is 20 mm to 120 mm and wherein a wall thickness of the top and bottom covers is more than 1 mm and wherein the top and bottom covers define a magnetic field path and provide environment protection;

a separate solid cylindrical rod core of cold-formed insulating Fe—Al—Si with 0.1% to 10% copper magnetic powder and having reduced release friction and increased green part strength and an outer diameter less than an inner diameter of the through holes in the top and bottom covers and a length of more than 52 mm; and a coil wound on the rod core so as to provide an inductive magnetic field with two electrical connectors at two ends wherein the electrical connectors extend through a respective rectangular hole of the top and bottom covers separately and wherein the top cover is glued to the bottom cover.

2. The magnetic component assembly of claim 1, further comprising an insulating bobbin around which the coil is wound and which is assembled with the rod core and the top and bottom covers.

* * * * *